US010478661B2

(12) United States Patent
Chavez

(10) Patent No.: US 10,478,661 B2
(45) Date of Patent: Nov. 19, 2019

(54) EXERCISE MAT WRAP AND ENSEMBLE

(71) Applicant: Selena Anne Chavez, Edgewater, CO (US)

(72) Inventor: Selena Anne Chavez, Edgewater, CO (US)

( * ) Notice: Subject to any disclaimer, the term of this patent is extended or adjusted under 35 U.S.C. 154(b) by 188 days.

(21) Appl. No.: 15/686,567

(22) Filed: Aug. 25, 2017

(65) Prior Publication Data

US 2019/0060702 A1 Feb. 28, 2019

(51) Int. Cl.
*A63B 21/00* (2006.01)
*A63B 71/00* (2006.01)

(52) U.S. Cl.
CPC ..... *A63B 21/4037* (2015.10); *A63B 21/4007* (2015.10); *A63B 21/4009* (2015.10); *A63B 21/4011* (2015.10); *A63B 21/4015* (2015.10); *A63B 21/4017* (2015.10); *A63B 21/4039* (2015.10); *A63B 71/0054* (2013.01); *A63B 2209/00* (2013.01); *A63B 2209/10* (2013.01); *A63B 2210/50* (2013.01); *A63B 2225/09* (2013.01)

(58) Field of Classification Search
None
See application file for complete search history.

(56) References Cited

U.S. PATENT DOCUMENTS

| | | | | |
|---|---|---|---|---|
| 3,096,759 | A * | 7/1963 | Coolbaugh | A61F 17/00 2/84 |
| 8,225,422 | B1 * | 7/2012 | McSparron | A41B 13/005 2/67 |
| 2010/0059558 | A1 * | 3/2010 | Robinson | A41D 3/08 224/155 |
| 2010/0205714 | A1 * | 8/2010 | Pollack | A47G 9/066 2/69 |
| 2010/0212060 | A1 * | 8/2010 | Whitcomb | A41B 13/06 2/75 |
| 2014/0352063 | A1 * | 12/2014 | Mitchell | A47G 9/0223 5/494 |

* cited by examiner

*Primary Examiner* — Sarah B McPartlin

(57) ABSTRACT

An exercise mat ensemble including an exercise mat coupled to an exercise mat wrap. The exercise mat wrap may include a left pocket attached to a left edge of a base portion and a right pocket attached to a right edge of the base portion. The left and right pockets may include enclosures accessible by a user laying on the base portion and/or the exercise mat. The left and right pockets may be formed by attaching upper pocket portions to lower pocket portions. The left and right pockets may be operable to fold across the top surface of the base portion. The exercise mat wrap may include a left flap attached to the left edge of the base portion and a right flap attached to the right edge of the base portion.

18 Claims, 8 Drawing Sheets

EXERCISE MAT WRAP AND ENSEMBLE

BACKGROUND OF THE INVENTION

At the end of a yoga practice, practitioners typically lay on their backs on a yoga mat in a pose called Shavasana, during which it is attempted to eliminate tiredness caused by other poses. Shavasana promotes calmness of the mind by maintaining a balance between relaxation and meditation. Due to various visual, audible, and/or temperature distractions presented by the practitioner's environment, it may become difficult to achieve a maximum level of meditation during Shavasana, thereby decreasing the practitioner's overall experience during a particular yoga session. Accordingly, there is a need in the art for products for reducing visual, audible, and/or temperature distractions during Shavasana.

BRIEF SUMMARY OF THE INVENTION

In a first embodiment of the present disclosure, an exercise mat ensemble is provided. The exercise mat ensemble may include a base portion having a left edge and a right edge extending in a longitudinal direction. The base portion may include a top surface operable to be substantially planar and extend between the left edge and the right edge. The exercise mat ensemble may include an exercise mat coupled to the top surface of the base portion. The exercise mat may include two longitudinal edges. The exercise mat ensemble may include a left pocket attached to a left edge of the base portion. The left pocket may include a first enclosure accessible from a side proximate to the left edge of the base portion. The left pocket may be formed by an upper left pocket portion attached to a lower left pocket portion. The left pocket may be operable to fold across the top surface of the base portion.

The exercise mat ensemble may also include a right pocket attached to a right edge of the base portion. The right pocket may include a second enclosure accessible from a side proximate to the right edge of the base portion. The right pocket may be formed by an upper right pocket portion attached to a lower right pocket portion. The right pocket may be operable to fold across the top surface of the base portion. The exercise mat ensemble may further include a left flap attached to the left edge of the base portion. The left flap may be offset from the left pocket in a longitudinal direction. The left flap may be operable to fold across the top surface of the base portion. The exercise mat ensemble may also include a right flap attached to the right edge of the base portion. The right flap may be offset from the right pocket in the longitudinal direction. The right flap may be operable to fold across the top surface of the base portion.

In some embodiments, a majority of the exercise mat may be covered by the left pocket, the right pocket, the left flap, and the right flap when the left pocket, the right pocket, the left flap, and the right flap are folded across the top surface of the base portion. In some embodiments, the exercise mat ensemble may include a bottom flap attached to a bottom edge of the base portion. The bottom flap may be operable to fold across the top surface of the base portion. In some embodiments, the bottom flap may include a semicircle. In some embodiments, the bottom flap may be attached to each of the bottom edge of the base portion, a bottom edge of the left flap, and a bottom edge of the right flap. In some embodiments, the upper left pocket portion, the lower left pocket portion, the upper right pocket portion, and the lower right pocket portion may include semicircles.

In some embodiments, the upper left pocket portion may be attached to the lower left pocket portion at a left pocket attachment region extending along a circumference of the lower left pocket portion. In some embodiments, the upper right pocket portion may be attached to the lower right pocket portion at a right pocket attachment region extending along a circumference of the lower right pocket portion. In some embodiments, the exercise mat may include a rectangular rubberized structure. In some embodiments, the exercise mat ensemble may include a base attachment member including at least one first VELCRO® brand (hook and loop fastener) strip attached to the top surface of the base portion and an exercise mat attachment member including at least one second VELCRO® brand (hook and loop fastener) strip attached to a bottom surface of the exercise mat. In some embodiments, the at least one second VELCRO® brand (hook and loop fastener) strip is attached to the at least one first VELCRO® brand (hook and loop fastener) strip. In some embodiments, the exercise mat may be attached to the top surface of the base portion using one or more zippers. In some embodiments, all of the exercise mat may be covered by the left pocket, the right pocket, the left flap, and the right flap when the left pocket, the right pocket, the left flap, and the right flap are folded across the top surface of the base portion.

In a second embodiment of the present disclosure, an exercise mat wrap is provided. The exercise mat wrap may include a base portion, a left pocket, a right pocket, a left flap, and a right flap as described herein.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
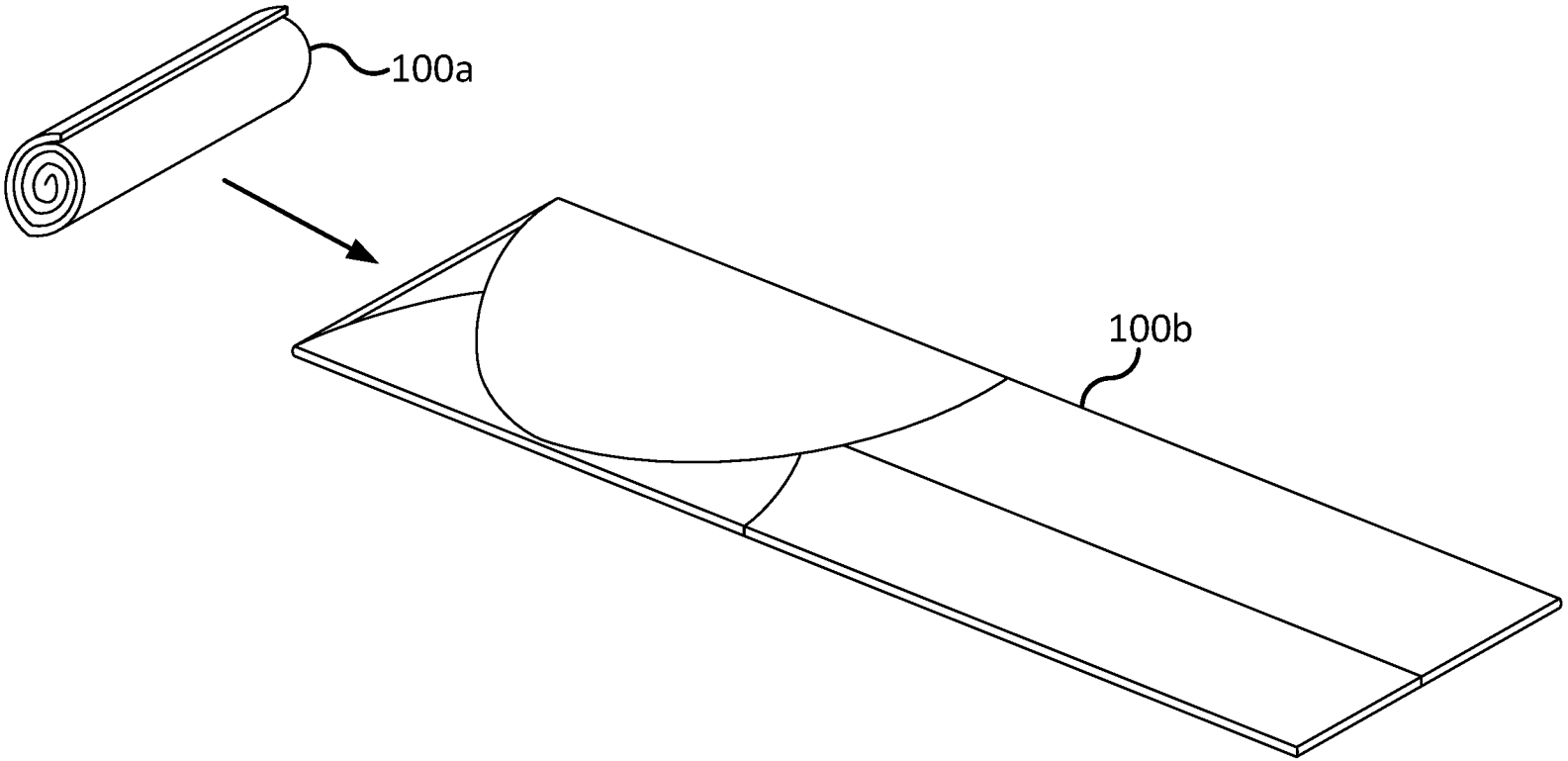
FIG. 1 illustrates a perspective view of folded and unfolded exercise mat ensembles, according to an example embodiment described in the present disclosure.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

Various example embodiments of the present disclosure will be described below with reference to the drawings constituting a part of the description. It should be understood that, although terms representing directions are used in the present disclosure, such as "front", "rear", "upper", "lower", "left", "right", and the like, for describing various example structural parts and elements of the present disclosure, these terms are used herein only for the purpose of convenience of explanation and are determined based on the example orientations shown in the drawings. Since the embodiments disclosed by the present disclosure can be arranged according to different directions, these terms representing directions are merely used for illustration and should not be regarded as limiting. Wherever possible, the same or similar reference marks used in the present disclosure refer to the same components.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

The present disclosure primarily relates to exercise mat ensembles for reducing visual, audible, and/or temperature distractions during Shavasana, which is a pose typically performed at the end of a yoga practice in which a practitioner lays on his back on top of a yoga mat. In some embodiments of the present disclosure, an exercise mat ensemble includes a wrap that may be folded across a practitioner to provide a barrier against various conditions which may distract the practitioner from relaxation and meditation. For example, an exercise mat ensemble of the present disclosure may provide a thermal barrier against temperature fluctuations that may occur in the surrounding environment. As another example, the material of an exercise mat ensemble of the present disclosure may be selected such that ambient noise present in the surrounding environment may be reduced prior to reaching the practitioner. These benefits, among others, are related to the structure and various components of the exercise mat ensemble as described herein.

FIG. 1 illustrates a perspective view of a folded exercise mat ensemble 100*a* and an unfolded exercise mat ensemble 100*b*, according to an example embodiment described in the present disclosure. Folded exercise mat ensemble 100*a* may have a shape similar to an ordinary folded exercise mat, such as a folded yoga mat. Folded exercise mat ensemble 100*a* may be placed within a containing apparatus (e.g., bag, yoga mat carrier) and transported to a location in which a practitioner desires to exercise. As depicted in FIG. 1, folded exercise mat ensemble 100*a* may be converted into unfolded exercise mat ensemble 100*b* by unfolding and laying the structure on the ground.

Figure 2:
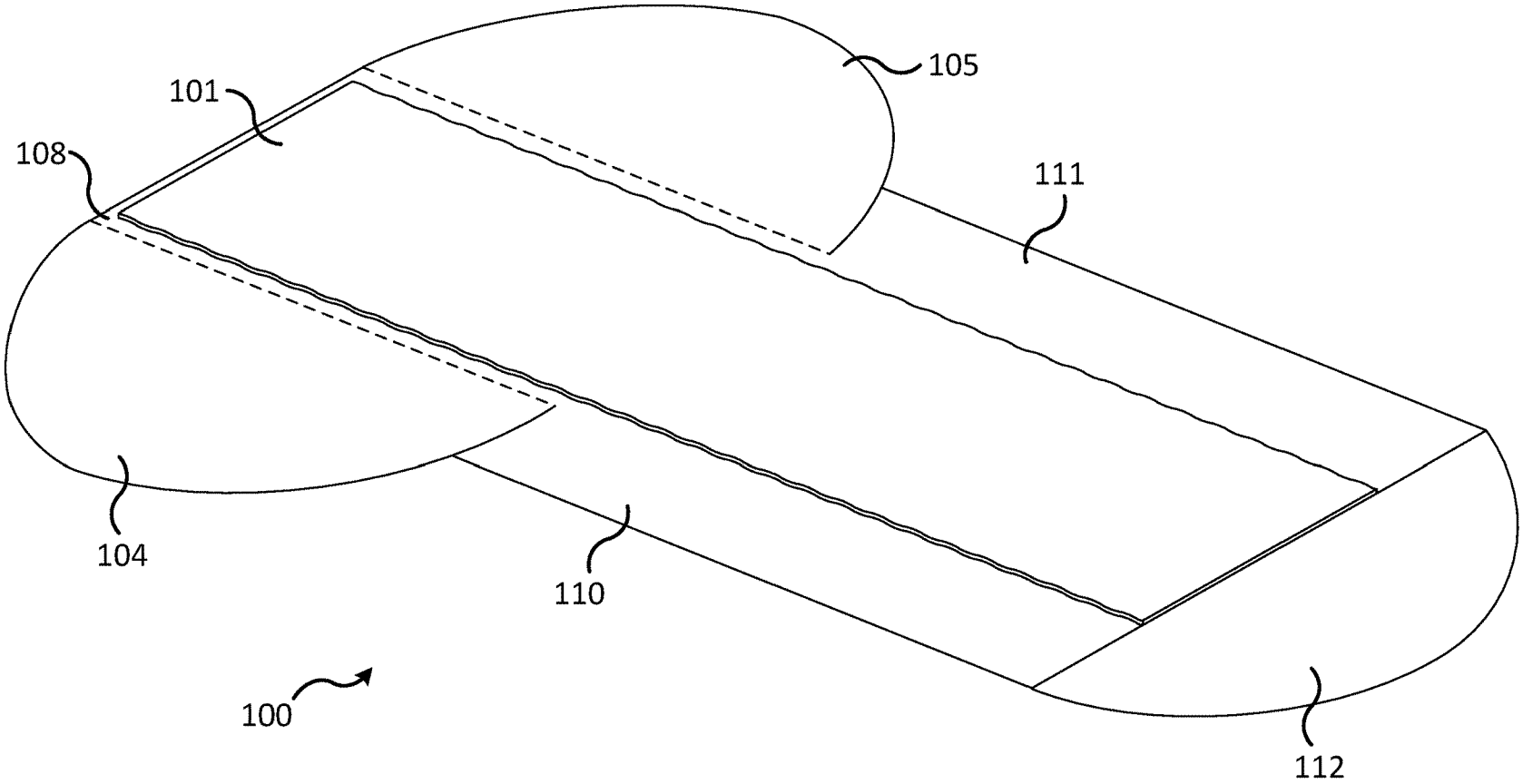
FIG. 2 illustrates a perspective view of an exercise mat ensemble, according to an example embodiment described in the present disclosure.

FIG. 2 illustrates a perspective view of an exercise mat ensemble 100, according to an example embodiment described in the present disclosure. In some embodiments, exercise mat ensemble 100 includes a base portion 108 that serves as a central connecting component for many of the components of exercise mat ensemble 100. Base portion 108 may include a left edge and a right edge extending parallel in the longitudinal direction. Base portion 108 may also include a top edge and a bottom edge extending parallel in the traverse direction. Accordingly, base portion 108 may be rectangular and may include a top surface operable to be substantially planar when exercise mat ensemble 100 is unfolded. In some embodiments, exercise mat ensemble 100 includes an exercise mat 101 coupled and/or attached to the top surface of base portion 108. Exercise mat 101 may include a rectangular rubberized structure, similar or identical to conventional exercise mats such as yoga mats. Optionally, exercise mat 101 may be detachable such that exercise mat 101 may be attached to base portion 108 after unfolding base portion 108.

In some embodiments, a left pocket 104 may be attached to the left edge of base portion 108 and a right pocket 105 may be attached to the right edge of base portion 108. Left pocket 104 may include an enclosure accessible from the side proximate (closest) to the left edge of base portion 108. In other words, the enclosure of left pocket 104 may face toward the right edge of base portion 108. For example, the enclosure of left pocket 104 may allow a user of exercise mat ensemble 100 to lay down vertically above base portion 108 and insert his/her right arm into the enclosure of left pocket 104 such that the user's right arm is partially or completely covered by left pocket 104. In some embodiments, left pocket 104 has a semicircle shape to allow easy insertion and removal of the user's right arm from the enclosure of left pocket 104.

Similarly, right pocket 105 may include an enclosure accessible from the side proximate (closest) to the right edge of base portion 108. In other words, the enclosure of right pocket 105 may face toward the left edge of base portion 108. For example, the enclosure of right pocket 105 may allow a user of exercise mat ensemble 100 to lay down vertically above base portion 108 and insert his/her left arm into the enclosure of right pocket 105 such that the user's left arm is partially or completely covered by right pocket 105. In some embodiments, right pocket 105 has a semicircle shape to allow easy insertion and removal of the user's left arm from the enclosure of right pocket 105.

Both left pocket 104 and right pocket 105 may be folded across the top surface of base portion 108, which may cause all or some portion of both base portion 108 and exercise mat 101 to be covered by left pocket 104 and right pocket 105. In some embodiments, when a user is laying on exercise mat 101, folding left pocket 104 and right pocket 105 may cause all or some portion of the user to be covered by left pocket 104 and right pocket 105.

In some embodiments, a left flap 110 is attached to the left edge of base portion 108 such that all or some portion of left flap 110 is offset from left pocket 104 in the longitudinal direction. For example, in some embodiments, left flap 110 may extend in the longitudinal direction along roughly 50% of the left edge of base portion 108. In some embodiments, left flap 110 may extend in the longitudinal direction along all of the left edge of base portion 108 such that left flap 110 and left pocket 104 overlap. Left flap 110 may be folded across the top surface of base portion 108 which may cause all or some portion of both base portion 108 and exercise mat 101 to be covered by left flap 110. In some embodiments, when a user is laying on exercise mat 101, folding left flap 110 may cause all or some portion of the user to be covered by left flap 110.

In some embodiments, a right flap 111 is attached to the right edge of base portion 108 such that all or some portion of right flap 111 is offset from right pocket 105 in the longitudinal direction. For example, in some embodiments, right flap 111 may extend in the longitudinal direction along roughly 50% of the right edge of base portion 108. In some embodiments, right flap 111 may extend in the longitudinal direction along all of the right edge of base portion 108 such that right flap 111 and right pocket 105 overlap. Right flap 111 may be folded across the top surface of base portion 108 which may cause all or some portion of both base portion 108 and exercise mat 101 to be covered by right flap 111. In some embodiments, when a user is laying on exercise mat 101, folding right flap 111 may cause all or some portion of the user to be covered by right flap 111.

In some embodiments, a bottom flap 112 is attached to the bottom edge of base portion 108. Bottom flap 112 may be rectangular or may have a semicircle shape. Bottom flap 112 may extend in the traverse direction along all or some portion of the bottom edge of base portion 108. In some embodiments, bottom flap 112 may be attached to each of the bottom edge of base portion 108, a bottom edge of left flap 110, and a bottom edge of right flap 111. In some embodiments, bottom flap 112 may extend in the traverse direction along all of the bottom edge of base portion 108, the bottom edge of left flap 110, and the bottom edge of right flap 111, but may not be attached to left flap 110 or right flap 111, thus forming two slits between bottom flap 112 and each of left flap 110 and right flap 111. Bottom flap 112 may be folded across the top surface of base portion 108 which may cause all or some portion of both base portion 108 and exercise mat 101 to be covered by bottom flap 112. In some embodiments, when a user is laying on exercise mat 101, folding bottom flap 112 may cause all or some portion of the user to be covered by bottom flap 112.

In some embodiments, the structure formed by base portion 108, left pocket 104, right pocket 105, left flap 110, right flap 111, and bottom flap 112 is referred to as a wrap or an exercise mat wrap. Therefore, in some instances, exercise mat ensemble 100 may comprise exercise mat 101 coupled to an exercise mat wrap.

Figure 3:
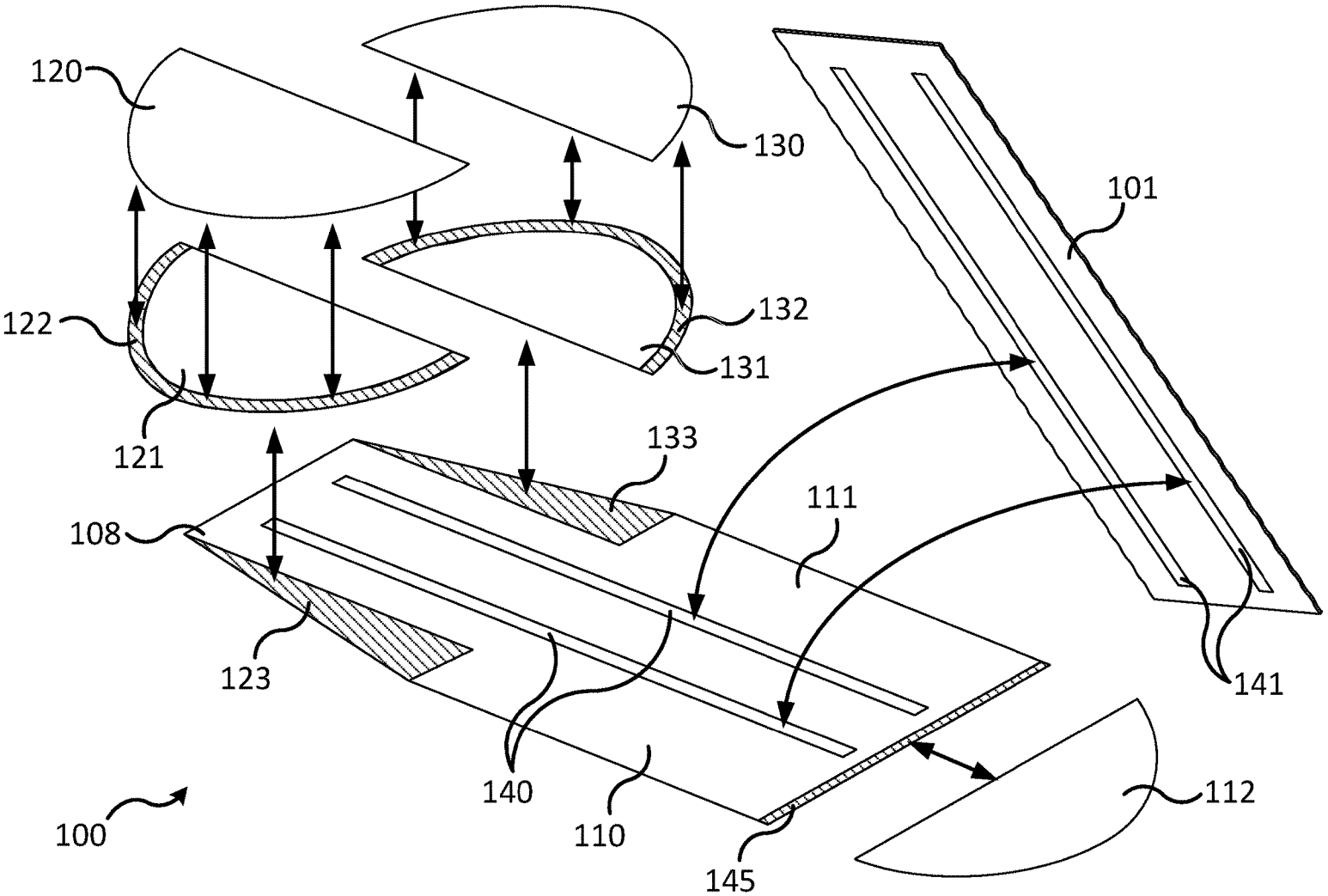
FIG. 3 illustrates an exploded view of an exercise mat ensemble, according to an example embodiment described in the present disclosure.

FIG. 3 illustrates an exploded view of exercise mat ensemble 100, according to an example embodiment described in the present disclosure. In some embodiments, left pocket 104 comprises an upper left pocket portion 120 and a lower left pocket portion 121 which are attached to each other at or along a left pocket attachment region 122 extending along a circumference of the upper left pocket portion 120 and/or a circumference of the lower left pocket portion 121. In some instances, upper left pocket portion 120 and lower left pocket portion 121 comprise identical semicircles. Left pocket 104 may be attached to the left edge of base portion 108 at or along a left base attachment region 123. Left base attachment region 123 may be triangular, rectangular, linear, or of some other shape.

Similarly, right pocket 105 comprises an upper right pocket portion 130 and a lower right pocket portion 131 which are attached to each other at or along a right pocket attachment region 132 extending along a circumference of the upper right pocket portion 130 and/or a circumference of the lower right pocket portion 131. In some instances, upper right pocket portion 130 and lower right pocket portion 131 comprise identical semicircles. Right pocket 105 may be attached to the right edge of base portion 108 at or along a right base attachment region 133. Right base attachment region 133 may be triangular, rectangular, linear, or of some other shape.

In some instances, exercise mat ensemble 100 includes a base attachment member 140 attached to the top surface of base portion 108 and an exercise mat attachment member 141 attached to a bottom surface of exercise mat 101. Both base attachment member 140 and exercise mat attachment member 141 may include one or more VELCRO® brand (hook and loop fastener) strips operable to attach to each other. For example, in some embodiments, both base attachment member 140 and exercise mat attachment member 141 may include two parallel VELCRO® brand (hook and loop fastener) strips extending in the longitudinal direction. In some embodiments, exercise mat ensemble 100 does not include base attachment member 140 and exercise mat attachment member 141, and instead exercise mat 101 is coupled to the top surface of base portion 108 by resting exercise mat 101 vertically above base portion 108.

In some embodiments, bottom flap 112 is attached to the bottom edge of base portion 108 at or along a bottom flap attachment region 145. Bottom flap attachment region 145 may extend in the traverse direction along all of the bottom edge of base portion 108, the bottom edge of left flap 110, and the bottom edge of right flap 111, or may extend along only the bottom edge of base portion 108. Bottom flap attachment region 112 may be triangular, rectangular, linear, or of some other shape.

Figure 4:
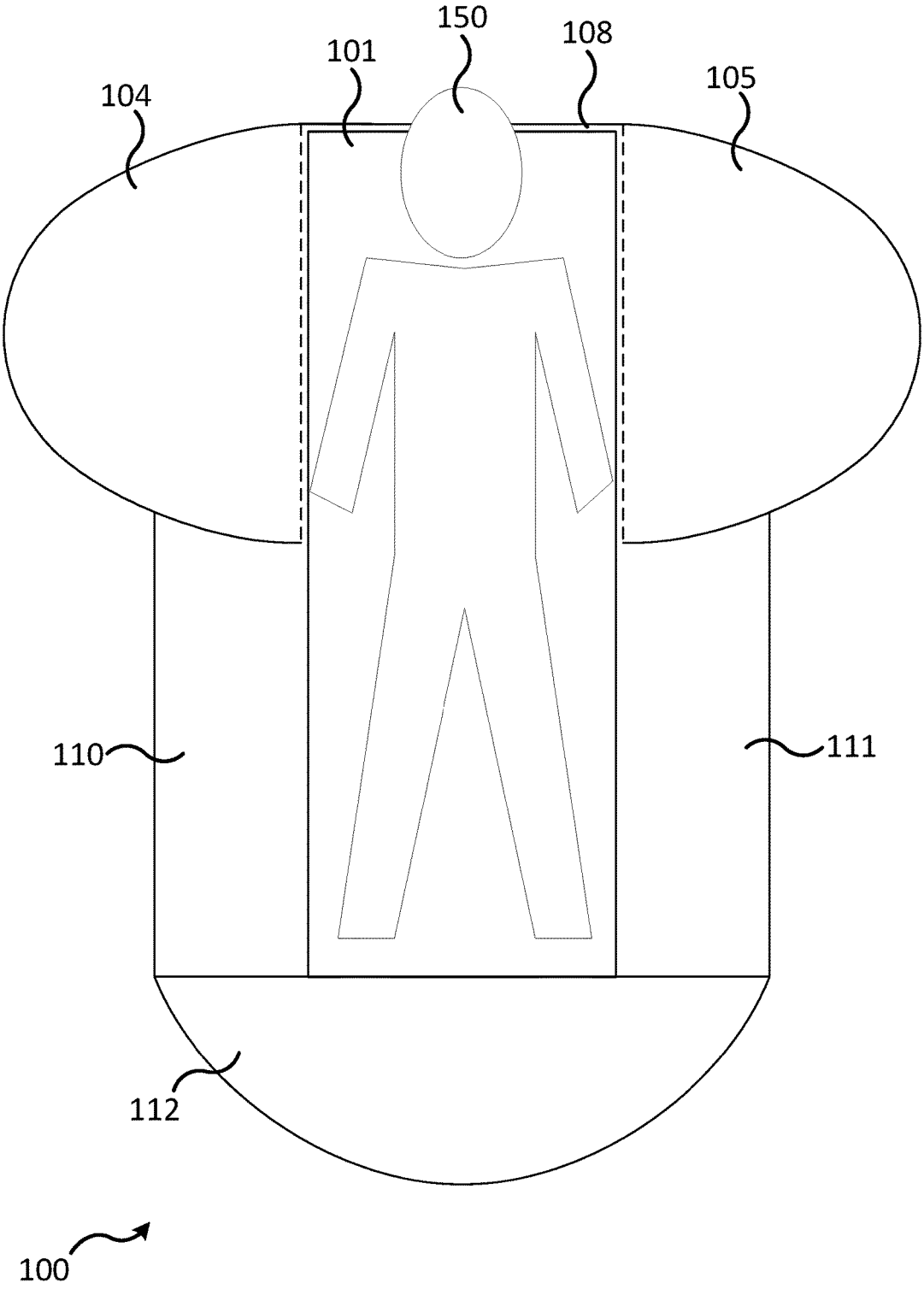
FIG. 4 illustrates a top view of an exercise mat ensemble, according to an example embodiment described in the present disclosure.
Figure 5:
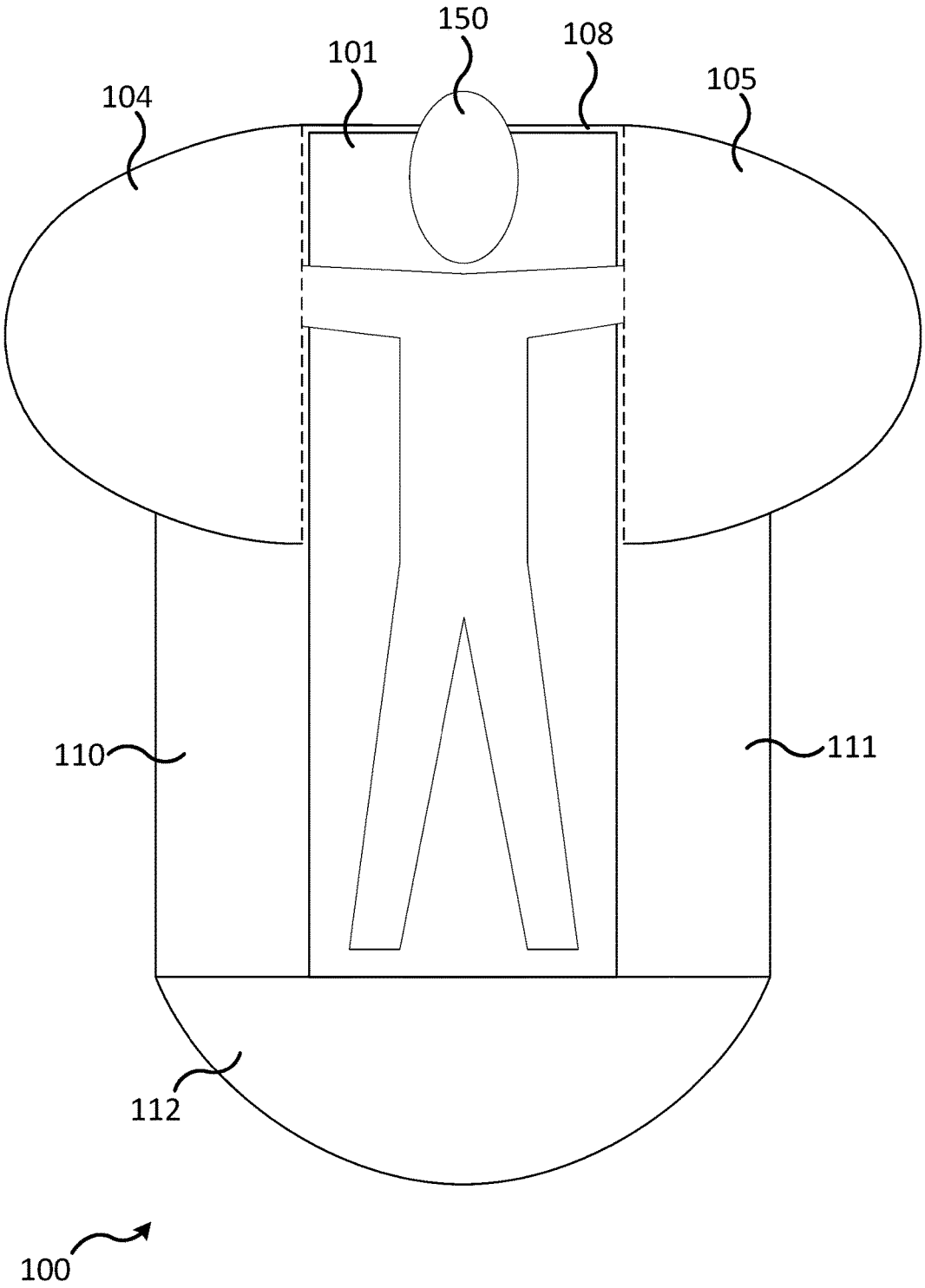
FIG. 5 illustrates a top view of an exercise mat ensemble, according to an example embodiment described in the present disclosure.
Figure 6:
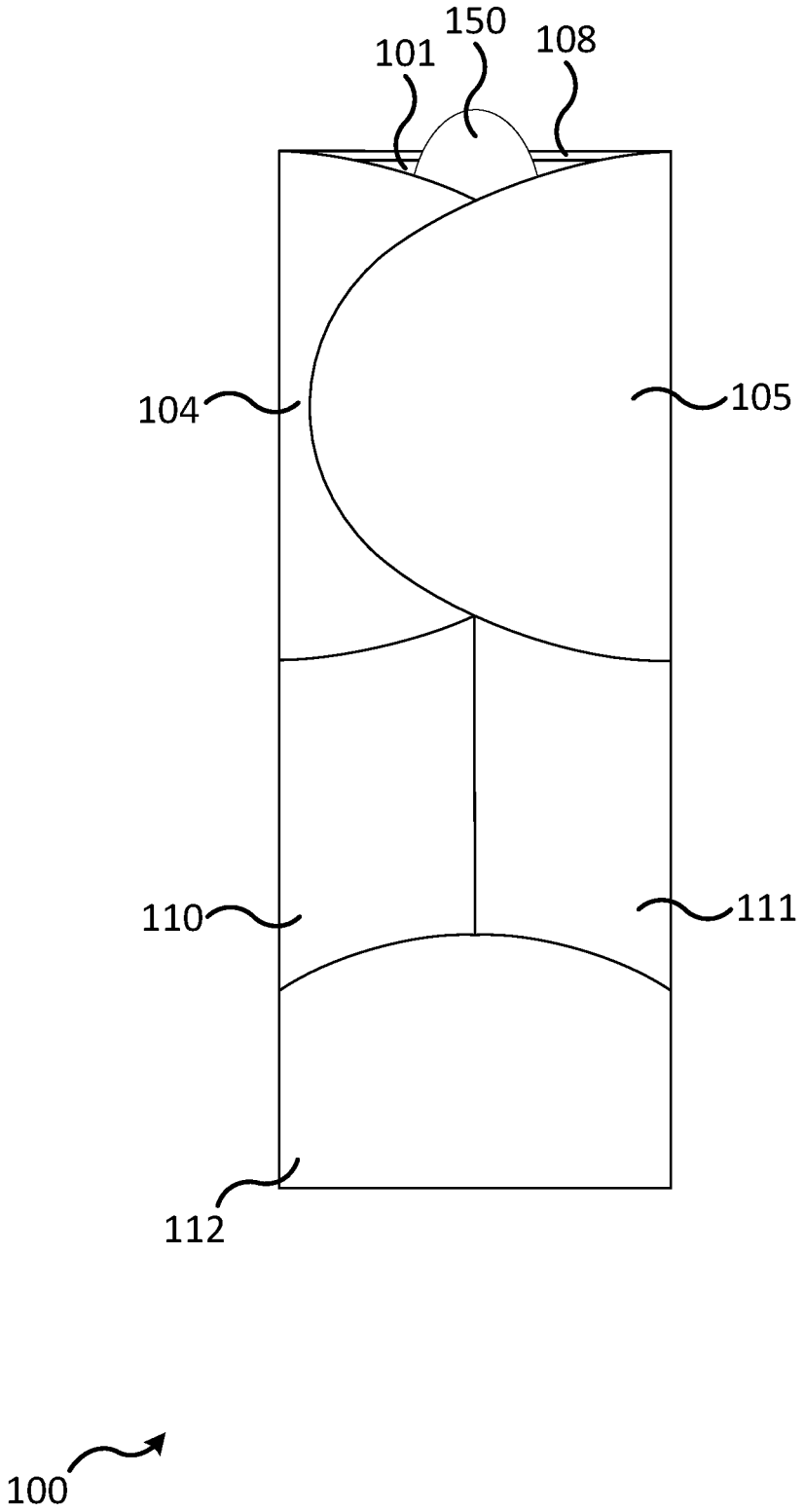
FIG. 6 illustrates a top view of an exercise mat ensemble, according to an example embodiment described in the present disclosure.

FIGS. 4, 5, and 6 illustrate top views of exercise mat ensemble 100 that depict a method of using exercise mat ensemble 100, according to an example embodiment described in the present disclosure. In FIG. 4, a user 150 lays on top of exercise mat 101 and base portion 108. In FIG. 5, user 150 inserts his/her right arm into the enclosure of left pocket 104 and his/her left arm into the enclosure of right pocket 105. In FIG. 6, user 150 folds left pocket 104, right pocket 105, left flap 110, right flap 111, and bottom flap 112 across the top of user 150, exercise mat 101, and base portion 108 such that at least a portion of user 150 is covered.

Figure 7:
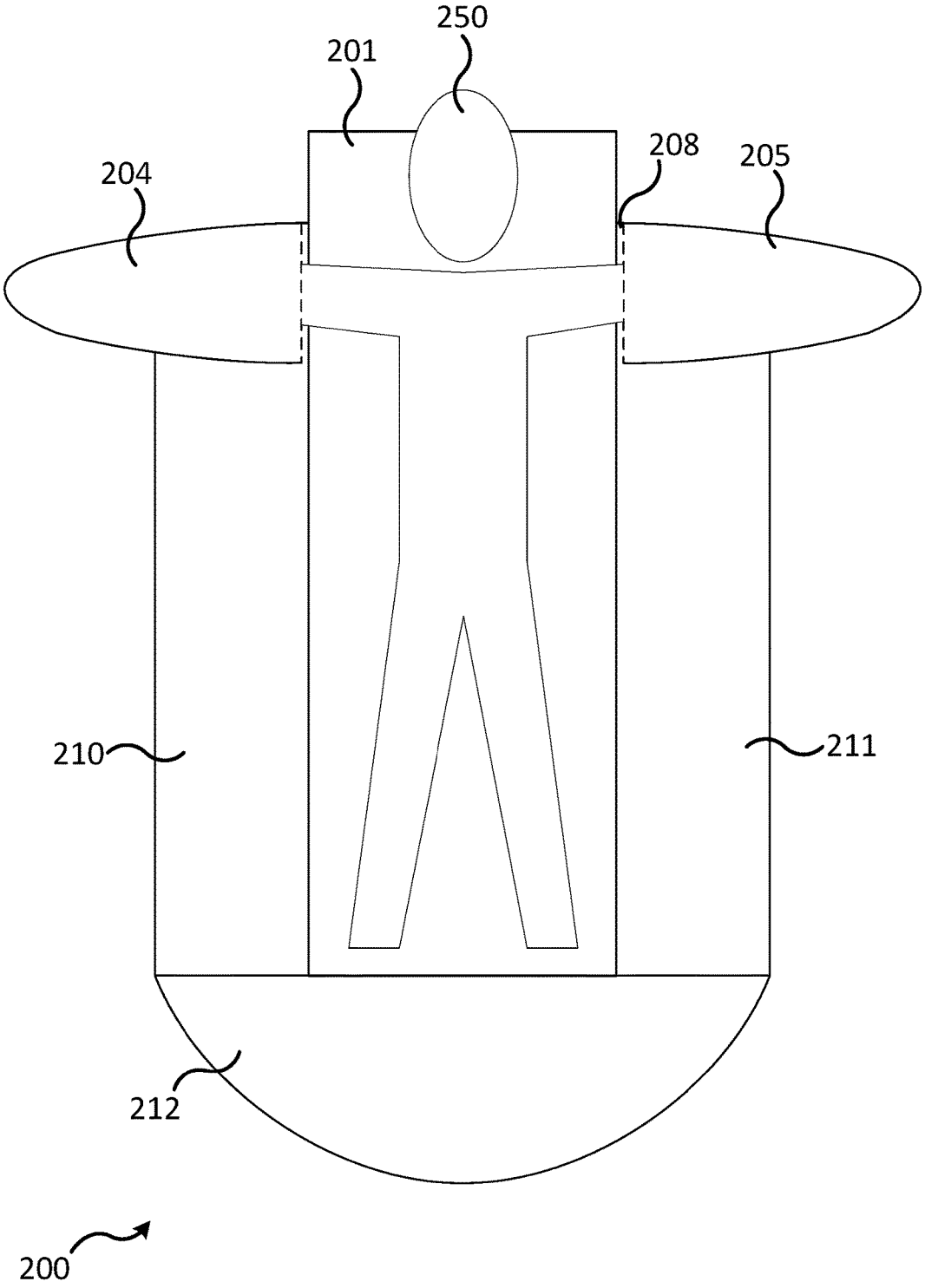
FIG. 7 illustrates a top view of an exercise mat ensemble, according to an example embodiment described in the present disclosure.
Figure 8:
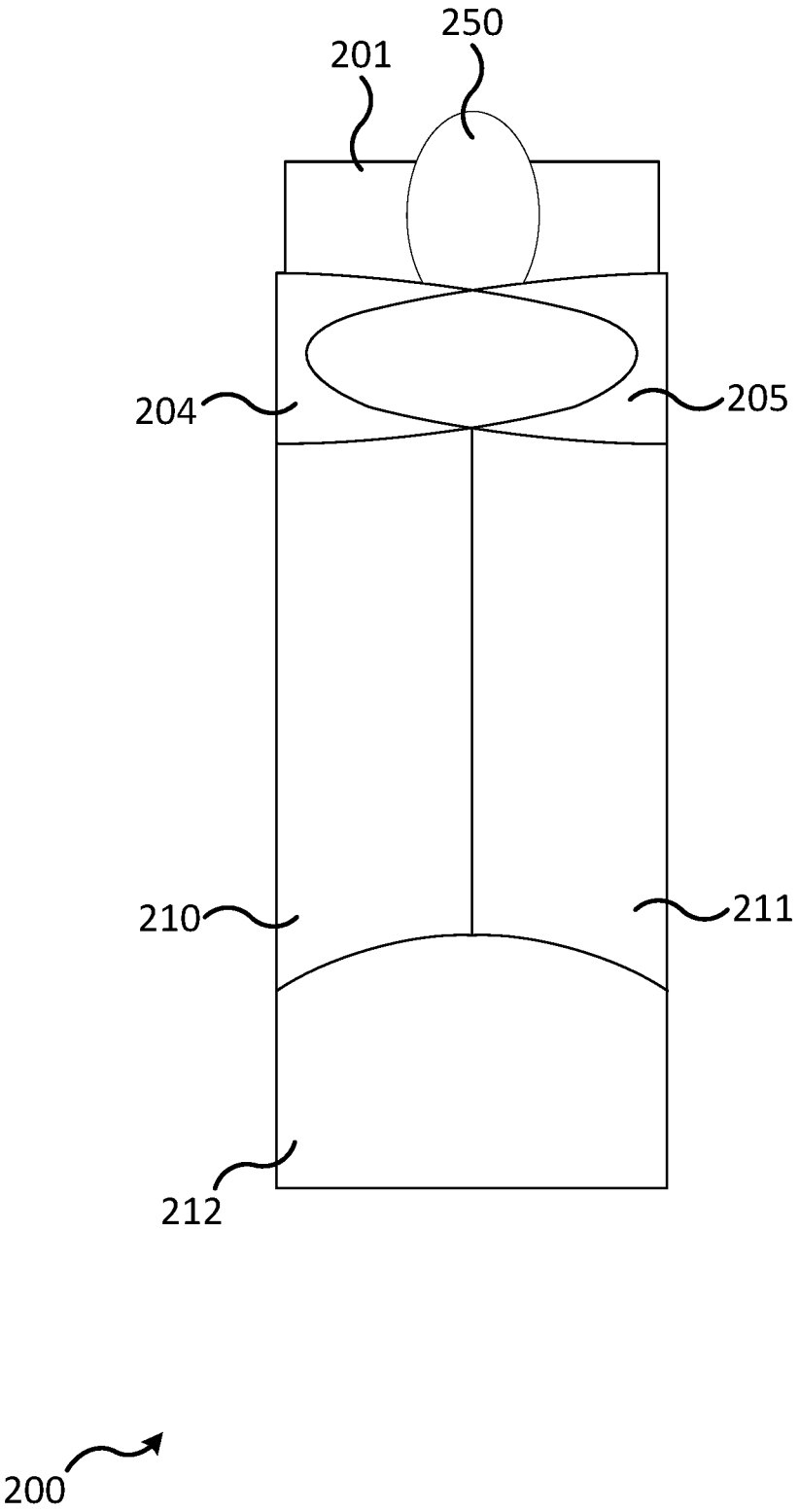
FIG. 8 illustrates a top view of an exercise mat ensemble, according to an example embodiment described in the present disclosure.

FIGS. 7 and 8 illustrate top views of an exercise mat ensemble 200 that depict a method of using exercise mat ensemble 200, according to an example embodiment described in the present disclosure. Exercise mat ensemble 200 may differ from exercise mat ensemble 100 at least in the sizes of left pocket 204 (compared to left pocket 104) and right pocket 205 (compared to right pocket 205). In some instances, the narrower sizes of left pocket 204 and right pocket 205 improve performance of exercise mat ensemble 200 by more closely fitting around the user's arms. In FIG. 7, a user 250 lays on top of exercise mat 201 and base portion 208 and inserts his/her right arm into the enclosure of left pocket 204 and his/her left arm into the enclosure of right pocket 205. In FIG. 8, user 250 folds left pocket 204, right pocket 205, left flap 210, right flap 211, and bottom flap 212 across the top of user 250, exercise mat 201, and base portion 208 such that at least a portion of user 250 is covered.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "composed", "include", "including", and "includes", when used in this specification and in the following claims, are intended to specify the presence of stated features, integers, components, or steps, but they do not preclude the presence or addition of one or more other features, integers, components, steps, acts, or groups.

Components described herein as being attached to each other may be attached via any one of several means. For example, two components may be attached by using glue, tape, stitching, VELCRO® brand (hook and loop fastener), zippers, buttons, among other possibilities. Components described herein may be composed of any number of materials, such as fabric, microfiber, fleece, rubber, and the like.

LIST OF TERMS

100—Exercise Mat Ensemble
100*a*—Folded Exercise Mat Ensemble
100*b*—Unfolded Exercise Mat Ensemble
101—Exercise Mat
104—Left Pocket
105—Right Pocket
108—Base Portion
110—Left Flap
111—Right Flap
112—Bottom Flap
120—Upper Left Pocket Portion
121—Lower Left Pocket Portion
122—Left Pocket Attachment Region
123—Left Base Attachment Region
130—Upper Right Pocket Portion
131—Lower Right Pocket Portion
132—Right Pocket Attachment Region
133—Right Base Attachment Region
140—Base Attachment Member
141—Exercise Mat Attachment Member
145—Bottom Flap Attachment Region
150—User
200—Exercise Mat Ensemble
201—Exercise Mat
204—Left Pocket
205—Right Pocket
208—Base Portion
210—Left Flap
211—Right Flap
212—Bottom Flap
250—User

What is claimed is:

1. An exercise mat ensemble comprising:

a base portion having a left edge and a right edge extending in a longitudinal direction, and a top surface operable to be substantially planar and extend between the left edge and the right edge;

an exercise mat coupled to the top surface of the base portion, the exercise mat having two longitudinal edges;

a left pocket attached to a left edge of the base portion, the left pocket including a first enclosure accessible from a side proximate to the left edge of the base portion, wherein the left pocket is formed by an upper left pocket portion attached to a lower left pocket portion, the left pocket being operable to fold across the top surface of the base portion;

a right pocket attached to a right edge of the base portion, the right pocket including a second enclosure accessible from a side proximate to the right edge of the base portion, wherein the right pocket is formed by an upper right pocket portion attached to a lower right pocket portion, the right pocket being operable to fold across the top surface of the base portion;

a left flap attached to the left edge of the base portion, the left flap being offset from the left pocket in a longitudinal direction, the left flap being operable to fold across the top surface of the base portion; and a right flap attached to the right edge of the base portion, the right flap being offset from the right pocket in the longitudinal direction, the right flap being operable to fold across the top surface of the base portion;

wherein a majority of the exercise mat is covered by the left pocket, the right pocket, the left flap, and the right flap when the left pocket, the right pocket, the left flap, and the right flap are folded across the top surface of the base portion; and wherein the upper left pocket portion, the lower left pocket portion, the upper right pocket portion, and the lower right pocket portion comprise semicircles.

2. The exercise mat ensemble of claim 1, further comprising:

a bottom flap attached to a bottom edge of the base portion, the bottom flap being operable to fold across the top surface of the base portion.

3. The exercise mat ensemble of claim 2, wherein the bottom flap comprises a semicircle.

4. The exercise mat ensemble of claim 3, wherein the bottom flap is attached to each of the bottom edge of the base portion, a bottom edge of the left flap, and a bottom edge of the right flap.

5. The exercise mat ensemble of claim 1, wherein:

the upper left pocket portion is attached to the lower left pocket portion at a left pocket attachment region extending along a circumference of the lower left pocket portion; and the upper right pocket portion is attached to the lower right pocket portion at a right pocket attachment region extending along a circumference of the lower right pocket portion.

6. The exercise mat ensemble of claim 1, wherein the exercise mat comprises a rectangular rubberized structure.

7. The exercise mat ensemble of claim 1, further comprising:

a base attachment member comprising at least one first hook and loop fastener strip attached to the top surface of the base portion; and an exercise mat attachment member comprising at least one second hook and loop fastener strip attached to a bottom surface of the exercise mat, wherein the at least one second hook and loop fastener strip is attached to the at least one first hook and loop fastener strip.

8. The exercise mat ensemble of claim 1, wherein the exercise mat is attached to the top surface of the base portion using one or more zippers.

9. The exercise mat ensemble of claim 1, wherein all of the exercise mat is covered by the left pocket, the right pocket, the left flap, and the right flap when the left pocket, the right pocket, the left flap, and the right flap are folded across the top surface of the base portion.

10. An exercise mat wrap comprising:

a base portion having a left edge and a right edge extending in a longitudinal direction, and a top surface operable to be substantially planar and extend between the left edge and the right edge, wherein an exercise mat is coupled to the top surface of the base portion, the exercise mat having two longitudinal edges;

a left pocket attached to a left edge of the base portion, the left pocket including a first enclosure accessible from a side proximate to the left edge of the base portion, wherein the left pocket is formed by an upper left pocket portion attached to a lower left pocket portion, the left pocket being operable to fold across the top surface of the base portion;

a right pocket attached to a right edge of the base portion, the right pocket including a second enclosure accessible from a side proximate to the right edge of the base portion, wherein the right pocket is formed by an upper right pocket portion attached to a lower right pocket portion, the right pocket being operable to fold across the top surface of the base portion;

a left flap attached to the left edge of the base portion, the left flap being offset from the left pocket in a longitudinal direction, the left flap being operable to fold across the top surface of the base portion; and a right flap attached to the right edge of the base portion, the right flap being offset from the right pocket in the longitudinal direction, the right flap being operable to fold across the top surface of the base portion;

wherein a majority of the exercise mat is covered by the left pocket, the right pocket, the left flap, and the right flap when the left pocket, the right pocket, the left flap, and the right flap are folded across the top surface of the base portion;

and wherein the upper left pocket portion, the lower left pocket portion, the upper right pocket portion, and the lower right pocket portion comprise semicircles; and/or the exercise mat comprises a rectangular rubberized structure.

11. The exercise mat wrap of claim 10, further comprising:

a bottom flap attached to a bottom edge of the base portion, the bottom flap being operable to fold across the top surface of the base portion.

12. The exercise mat wrap of claim 11, wherein the bottom flap comprises a semicircle.

13. The exercise mat wrap of claim 12, wherein the bottom flap is attached to each of the bottom edge of the base portion, a bottom edge of the left flap, and a bottom edge of the right flap.

14. The exercise mat wrap of claim 10, wherein:

the upper left pocket portion is attached to the lower left pocket portion at a left pocket attachment region extending along a circumference of the lower left pocket portion; and the upper right pocket portion is attached to the lower right pocket portion at a right pocket attachment region extending along a circumference of the lower right pocket portion.

15. The exercise mat wrap of claim 10, further comprising:

a base attachment member comprising at least one first hook and loop fastener strip attached to the top surface of the base portion, wherein the at least one first hook and loop fastener strip is attachable to at least one second hook and loop fastener strip attached to a bottom surface of the exercise mat.

16. The exercise mat ensemble of claim 10, wherein the exercise mat is attached to the top surface of the base portion using one or more zippers.

17. The exercise mat ensemble of claim 10, wherein all of the exercise mat is covered by the left pocket, the right pocket, the left flap, and the right flap when the left pocket, the right pocket, the left flap, and the right flap are folded across the top surface of the base portion.

18. An exercise mat ensemble comprising:

a base portion having a left edge and a right edge extending in a longitudinal direction, and a top surface operable to be substantially planar and extend between the left edge and the right edge;

an exercise mat coupled to the top surface of the base portion, the exercise mat having two longitudinal edges;

a left pocket attached to a left edge of the base portion, the left pocket including a first enclosure accessible from a side proximate to the left edge of the base portion, wherein the left pocket is formed by an upper left pocket portion attached to a lower left pocket portion, the left pocket being operable to fold across the top surface of the base portion;

a right pocket attached to a right edge of the base portion, the right pocket including a second enclosure accessible from a side proximate to the right edge of the base portion, wherein the right pocket is formed by an upper right pocket portion attached to a lower right pocket portion, the right pocket being operable to fold across the top surface of the base portion;

a left flap attached to the left edge of the base portion, the left flap being offset from the left pocket in a longitudinal direction, the left flap being operable to fold across the top surface of the base portion; and a right flap attached to the right edge of the base portion, the right flap being offset from the right pocket in the longitudinal direction, the right flap being operable to fold across the top surface of the base portion;

wherein a majority of the exercise mat is covered by the left pocket, the right pocket, the left flap, and the right flap when the left pocket, the right pocket, the left flap, and the right flap are folded across the top surface of the base portion; and wherein the exercise mat comprises a rectangular rubberized structure.

* * * * *